US006161321A

United States Patent [19]

Huber

[11] Patent Number: 6,161,321

[45] Date of Patent: Dec. 19, 2000

[54] POSTING DEVICE

[76] Inventor: Alexandra Watkins Huber, 339 E. 88th St., Apt. 2R, New York, N.Y. 10128

[21] Appl. No.: 09/256,356

[22] Filed: Feb. 24, 1999

[51] Int. Cl.[7] ..... A47G 1/06

[52] U.S. Cl. ..... 40/789; 40/774; 40/775

[58] Field of Search ..... 40/774, 775, 789, 40/654.01, 159 FOR, 759, 124.06, 754, 750, 751, 752, FOR 100, 757, 786, 788

[56] References Cited

U.S. PATENT DOCUMENTS 4,165,890 8/1979 Leff ..... 40/654.01

FOREIGN PATENT DOCUMENTS 1918880 12/1969 Germany ..... 40/159
3028215 2/1982 Germany ..... 40/661
2195887 4/1988 United Kingdom ..... 40/152

*Primary Examiner*—Cassandra H. Davis
*Attorney, Agent, or Firm*—Hogan & Hartson LLP; Celine Jimenez Crowson

[57] ABSTRACT

A posting or framing device for displaying a generally flat, lightweight item to be displayed comprising: a body portion formed from a pair of walls which define a pocket to receive the item to displayed, the walls being such as to permit the item to be displayed to be seen therethrough; and a tab extending from at least one edge of the body portion by means of which the posting or framing device can be affixed to a surface.

6 Claims, 3 Drawing Sheets

POSTING DEVICE

FIELD OF THE INVENTION

The invention relates to a frame or sleeve used to post or hang, e.g., photographs, postcards, documents, or any other flat, relatively light-weight object.

BACKGROUND OF THE INVENTION

Light-weight, flat items such as photographs or postcards are frequently posted on walls, for example to personalize one's work space. When the work space is a cubicle constructed from movable partitions having soft cores, or where there is a cork-type bulletin board available, such flat items typically are posted using thumb tacks or push-pins pushed directly through the item being posted. Posting items in this manner thus has the drawback that the item being posted is damaged.

Alternatively, the item being posted may be taped to the wall. Where the walls are cubicle partitions, with generally fuzzy coverings, or cork-type bulletin board material, however, tape generally does not stick to the wall as well as would be desired. Moreover, when photographs or postcards are posted using loops of tape on the backs thereof, the corners and edges tend to fray and/or curl, thereby degrading the appearance of the item.

Accordingly, there is need in the art for a device for posting items such as photographs or postcards which eliminates these problems, and which does so in an aesthetically pleasing manner.

SUMMARY OF THE INVENTION

The invention provides a device with which photographs, postcards, or other flat, light-weight items may be posted on a wall, e.g., using thumb tacks or push-pins. In one embodiment of the invention, the invention features a frame, constructed from a single, folded sheet of paper material, through which the item being posted is visible. In an alternative embodiment, the frame is constructed from a backing sheet to which is secured a frame sheet through which the item being posted is visible. In either embodiment, a slot in the edge of the frame is provided through which the photograph or postcard or other item is inserted into the frame. To facilitate posting, the frame has one or more tabs extending from the edges thereof. Preferably, in the context of a rectangular frame, the frame has tabs on adjacent edges such that the frame can be tacked up on a wall in either a landscape orientation or a portrait orientation.

In an additional embodiment, the invention features a protective sleeve into which a photograph or other item being posted is inserted and with which it is hung. Like the frame of the above embodiments, the sleeve of this embodiment has one or more tabs extending from edges thereof, preferably with two such tabs on adjacent edges to facilitate posting items in either a landscape or portrait orientation.

BRIEF DESCRIPTION OF THE DRAWINGS

The invention will now be described in detail in conjunction with the following drawings, in which.

DETAILED DESCRIPTION OF PREFERRED EMBODIMENTS

Figure 1B:
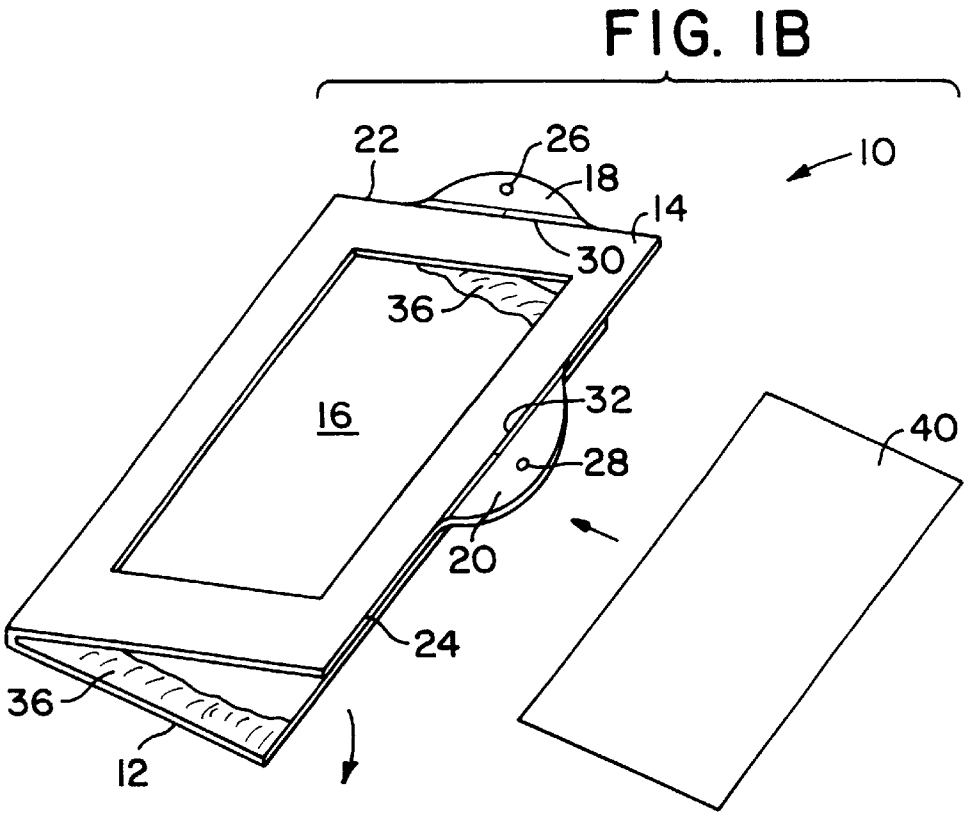
FIG. 1B is a perspective view demonstrating how the first embodiment is assembled and used.
Figure 1A:
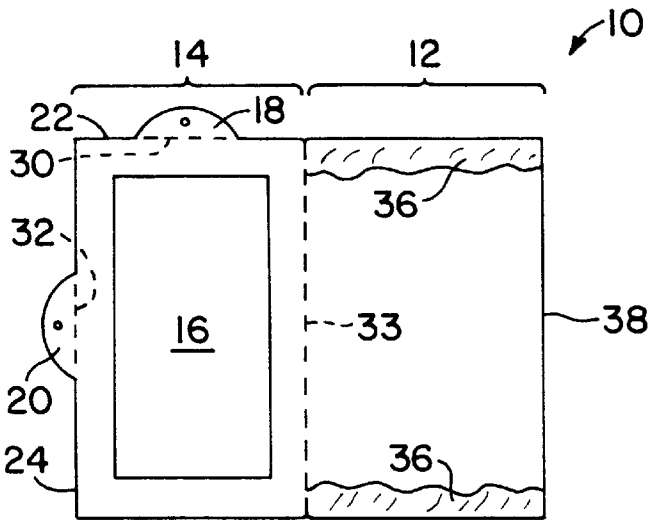
FIG. 1A is a flat pattern view of a first embodiment of a posting device according to the invention.

A first embodiment of a posting device according to the invention, e.g., a frame-type posting device, is shown in FIGS. 1A and 1B. The device 10 is constructed from a single, die-punched sheet of heavy stock paper, with a backing portion 12 and a frame portion 14 that is generally congruent with the backing portion 12. The frame portion 14 has a cut-out window 16 through which the item being posted will be visible.

Additionally, frame portion 14 has a pair of tabs 18 and 20 extending from adjacent edges 22 and 24, respectively. The tabs 18 and 20 preferably have small, die-punched holes 26 and 28 (FIG. 1B) extending through them, and the tabs preferably are creased, e.g., by embossing where they extend from the frame portion 14, i.e., along lines 30 and 32 (which may be scored).

The single sheet of paper is folded in half along fold line 33, in book fashion, and the frame portion 14 is joined to the backing portion 12 along the two edges of the frame which are on either side of the fold line 33, e.g., by a layer of adhesive 36 which is spread along those two edges. Because the frame portion 14 is not bonded to the backing portion 12 along the edge 38 opposite the fold line 33, a slot will be present along that edge through which an item to be hung or posted is inserted into the device, e.g., photograph or postcard 40.

If the photograph or postcard has a portrait orientation —i.e., it is to be oriented such that the long edges thereof extend vertically—then tab 20 may be cut along the embossment along line 32 and discarded. The photograph or postcard is then hung, e.g., on a bulletin board or cubicle partition wall by pressing a thumb tack or push-pin through hole 26 in tab 18. Alternatively, if the item 40 has a landscape orientation, i.e., the long edges thereof are oriented horizontally, tab 18 may be cut along the embossment extending along line 30 and discarded, and the item is posted by pressing a thumb tack or push-pin through hole 28 in tab 20. In this manner, the photograph, postcard, or other item being posted is not damaged and is hung in an aesthetically pleasing manner.

Figure 2:
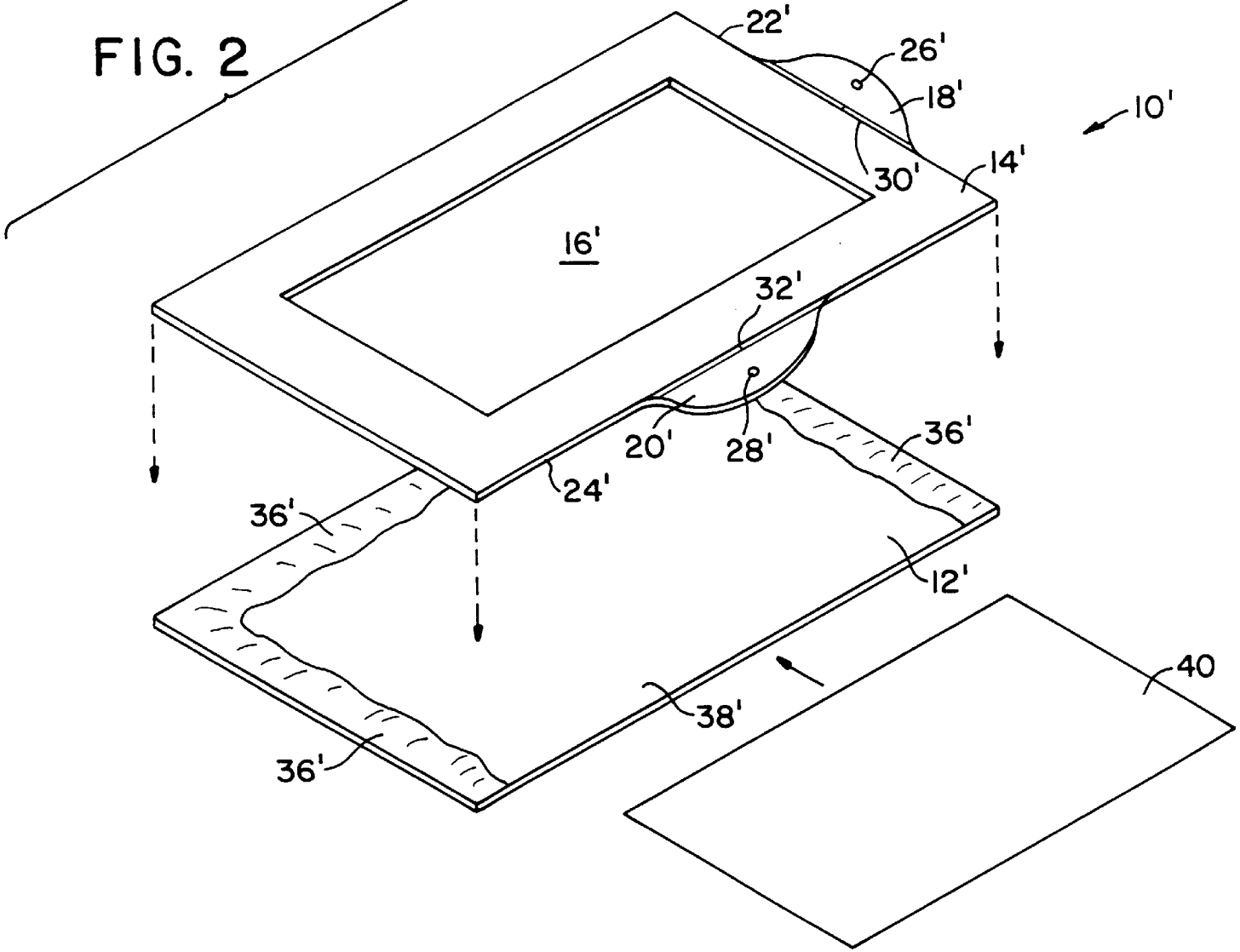
FIG. 2 is an assembly view, in perspective, of a second embodiment of a posting or hanging device according to the invention which is similar to the first embodiment.

A second embodiment of a posting device according to the invention, similar to the first, is shown in FIG. 2. The device 10' is constructed from a backing sheet 12', e.g., of heavy stock paper. Separate frame sheet 14' is generally congruent with backing sheet 12' and preferably is made from the same type of material, e.g., heavy stock paper. Frame sheet 14' has a cut-out window 16' through which the item being posted will be visible. Additionally, frame sheet 14' has a pair of tabs 18' and 20' extending from adjacent edges 22' and 24', respectively. The tabs 18' and 20' preferably have small die-punched holes 26' and 28' extending through them, and the tabs preferably are creased, e.g., by embossing where they extend from the frame sheet 14', i.e., along lines 30' and 32'.

The frame sheet 14' is joined to the backing sheet 12' along three edges of the frame, e.g., by a layer of adhesive 36' which is spread along those three edges. Because the frame sheet 14' is not bonded to the backing sheet 12' along the fourth edge 38', a slot will be present along that edge of the device through which an item to be hung or posted is inserted into the device, e.g., photograph or postcard 40.

If the photograph or postcard has a portrait orientation, then tab 20' may be cut along the embossment along line 32' and discarded. The photograph or postcard is then hung, e.g., on a bulletin board or cubicle partition wall by pressing a thumb tack or push-pin through hole 26' in tab 18'. Alternatively, if the item 40 has a landscape orientation, tab 18' may be cut along the embossment extending along line 30' and discarded, and the item is posted by pressing a thumb tack or push-pin through hole 28' in tab 20'.

Figure 3B:
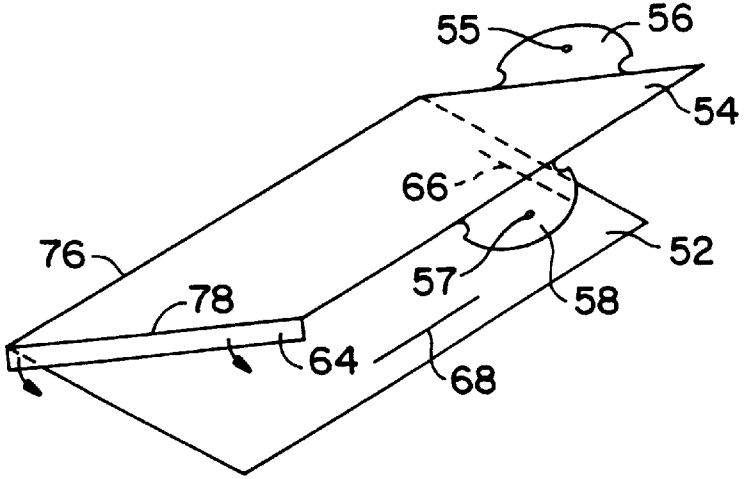
FIG. 3B is a perspective view demonstrating how the third embodiment is assembled and used.
Figure 3A:
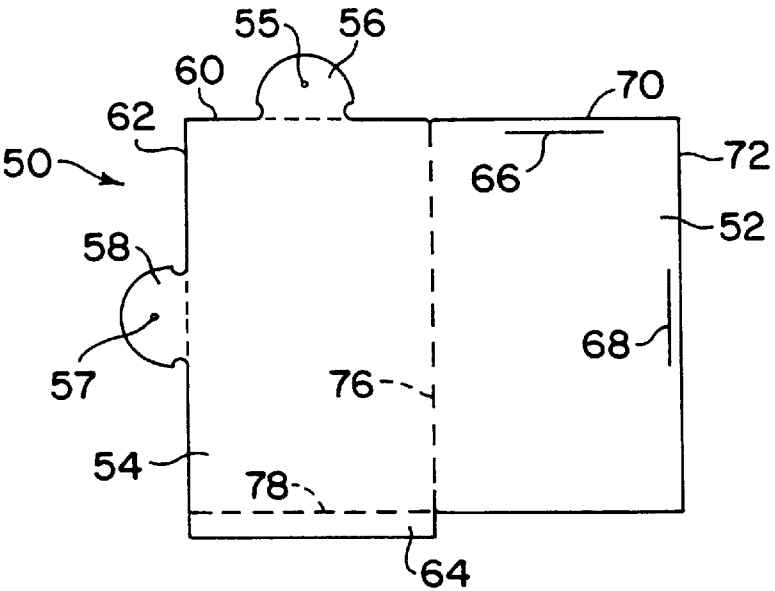
FIG. 3A is a flat pattern view of a third embodiment of a posting device according to the invention.

A third embodiment 50 of a posting or hanging device according to the invention is shown in FIGS. 3A and 3B. This embodiment 50 is formed from a single sheet of transparent material, e.g., a heavy polypropylene film. As shown in FIG. 3A, the device 50 is cut, e.g., by die-cutting, as a single, contiguous piece of material. The single piece of material has rectangular main portions 52 and 54, with tabs 56 and 58 extending from adjacent edges 60 and 62, respectively, of main section 54. A flap portion 64 also extends from main portion 54, and main portion 52 has slits 66 and 68 cut therein near edges 70 and 72, respectively.

As shown in FIGS. 3A and 3B, the main portions 52 and 54 are folded over on each other along fold line 76. The portions 52 and 54 are folded flat together, and flap portion 64 is then folded flat along fold line 78 and secured to the back, outer-facing surface of main portion 52, e.g., by sonic welding. At this point, the device 50 will be in the form of a pocket with two sealed edges and two open edges.

If the item being posted or displayed (not shown in FIG. 3B) has a portrait orientation, it is placed in the pocket formed between portions 52 and 54 so as to be visible through portion 54, and tab 58 is folded down behind portion 52 and inserted through slit 68 from the outside of the pocket into the interior of the pocket, i.e., such that tab 58 will be disposed between the item being posted and the inner-facing surface of portion 52. This helps to keep the pocket closed. The item is then posted, e.g., by tacking it to a wall, by means of tab 56 which may have hole 55 to facilitate same.

Alternatively, if the item being displayed has a landscape orientation, it is placed in the pocket so as to be visible through portion 54, and tab 56 is folded down behind portion 52 and inserted through slit 66 to secure the pocket closed, and the item is posted by tacking through tab 58 which may have hole 57 to facilitate same.

Other embodiments within the scope and spirit of the invention will occur to those having skill in the art.

What is claimed is:

1. A posting device for displaying a generally flat, light-weight item to be displayed, said posting device comprising:

a body portion formed from a pair of walls having the same general size which define a pocket to receive said item to be displayed, said walls being such as to permit said item to be displayed to be seen therethrough; and a tab extending from each of two adjacent edges of one of said walls of said body portion by means of which said posting device can be affixed to a surface, whereby said item to be displayed can be displayed in a landscape orientation or in a portrait orientation, said tabs each being creased where they extend from their respective edges to facilitate removal from view of the tab not used to affix the posting device to the surface.

2. The posting device of claim 1, wherein said posting device is made from paper and one of said walls has a cutout portion through which said item to be displayed may be seen.

3. The posting device of claim 1, wherein said posting device is made from transparent plastic through which said item to be displayed may be seen.

4. The posting device of claim 1, wherein said posting device is made from a single, contiguous sheet of material which is folded to form said pocket and wherein said walls are joined together along less than all edges thereof, a slot being formed along non-joined edges of said walls through which said item to be displayed can be inserted into said pocket.

5. The posting device of claim 1, wherein said posting device is made from a pair of sheets of material which are joined together to form said pocket and wherein said sheets of material are joined together along less than all edges thereof, a slot being formed along non-joined edges of said sheets of material through which said item to be displayed can be inserted into said pocket.

6. A posting device for displaying a generally flat, light-weight item to be displayed, said posting device comprising:

a rectangular body portion formed from a pair of walls having the same general size which define a pocket to receive said item to be displayed, said walls being such as to permit said item to be displayed to be seen therethrough; and a tab extending from each of two adjacent edges of said body portion by means of which said posting device can be affixed to a surface, whereby said item to be displayed can be displayed in a landscape orientation or in a portrait orientation, wherein said walls are joined along two adjacent edges not having tabs extending therefrom, said tabs extend from one of said pair of walls, and slots are provided in the other of said pair of walls near edges thereof and generally opposite to said tabs, whereby either one of said tabs can be folded over and inserted into its respective slot so as to join a third edge of said posting device while leaving the other of said tabs extending from the body portion for affixing said posting device to said vertical surface.

* * * * *